US005285902A

United States Patent [19]

Tabuenca Garcia

[11] Patent Number: 5,285,902

[45] Date of Patent: Feb. 15, 1994

[54] PACKAGING SYSTEM FOR PAINTINGS, OTHER WORKS OF ART AND THE LIKE

[76] Inventor: Ana Tabuenca Garcia, Avenida de Europa, No. 4, 28023 Pozuelo de Alarcón, Madrid, Spain

[21] Appl. No.: 898,488

[22] Filed: Jun. 15, 1992

[30] Foreign Application Priority Data

| | | | |
|---|---|---|---|
| Jun. 14, 1991 | [ES] | Spain | 9101433 |
| Jun. 14, 1991 | [ES] | Spain | 9101887 |
| Jun. 14, 1991 | [ES] | Spain | 9101888 |
| Jun. 27, 1991 | [ES] | Spain | 9102050 |

[51] Int. Cl.[5] ..... B65D 81/02; B65D 85/30

[52] U.S. Cl. ..... 206/583

[58] Field of Search ..... 206/583

[56] References Cited

U.S. PATENT DOCUMENTS

| | | | |
|---|---|---|---|
| 2,653,709 | 9/1953 | Cunningham et al. | 206/583 X |
| 4,664,254 | 5/1987 | Sitwell et al. | 206/583 X |

FOREIGN PATENT DOCUMENTS

| | | | |
|---|---|---|---|
| 1661070 | 7/1991 | U.S.S.R. | 206/583 |

*Primary Examiner*—William I. Price

*Attorney, Agent, or Firm*—McAulay Fisher Nissen Goldberg & Kiel

[57] ABSTRACT

It consists in fastening the painting (2) or article in question inside a frame (1) with the collaboration of belts (4) which are tensioned appropriately between buckles (5) so that each belt (4) has the configuration of a flat ring inside which the painting (2) is accommodated, the painting remaining fastened with the collaboration of half-clamps (6) mounted on the belts (4) and fastened by means of the clamps (9). In this manner, the painting (2) or article in question is mounted in a "floating" manner inside the frame (1) which, in turn, is mounted in a floating manner in the transport vehicle by means of vibration-insulating supports (3).

10 Claims, 5 Drawing Sheets

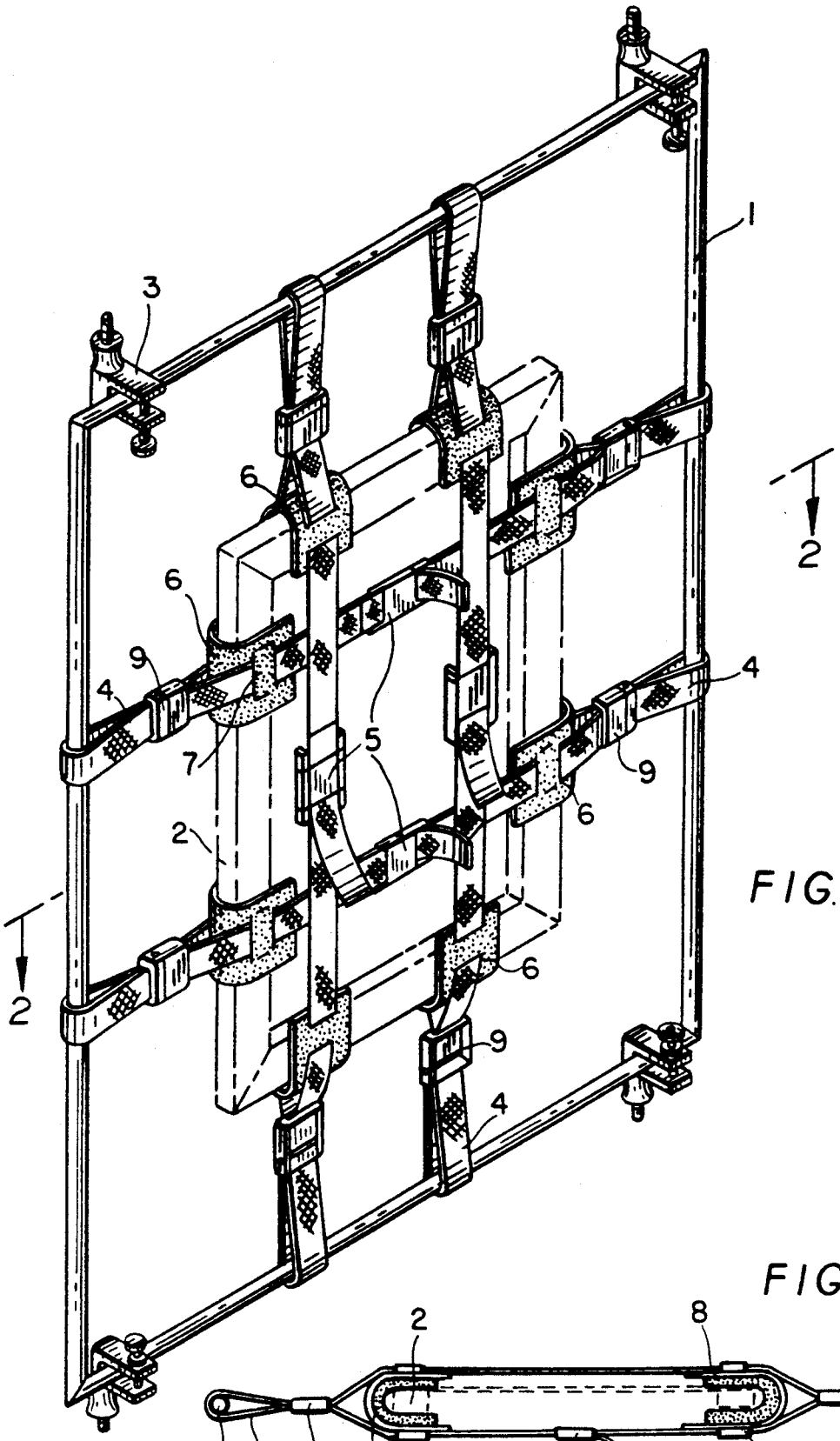
FIG. 1
FIG. 2
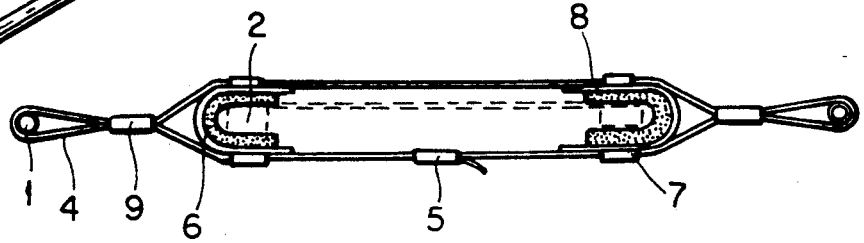

PACKAGING SYSTEM FOR PAINTINGS, OTHER WORKS OF ART AND THE LIKE

SUBJECT OF THE INVENTION

The present invention relates to a novel packaging system which has been specially designed for transporting works of art, especially for paintings, but which is also applicable to the transportation of any other type of article which has to be kept completely protected during said transportation from the effects produced by possible impacts, including the effects of vibrations, such as, for example, computer equipment amongst many other items.

BACKGROUND OF THE INVENTION

Focusing specifically on the field of works of art and more specifically on paintings, for which the recommended system has essentially been designed, one of the known solutions, which is regarded as being amongst the most suitable, consists in using a rectangular frame with sides which are grooved on the inside, on two of which, in correspondence with one of the vertices of the frame, the painting to be transported is inserted, remaining completely fastened by means of its two other edges, which are initially free with respect to the frame, by means of setscrews appropriately installed between said edges and the corresponding sectors of the said frame.

This solution results in a solid fastening of the frame of the painting to the frame, such that, by subsequently and appropriately fastening said frame inside the transport vehicle, the painting is immobilised and there is no risk of the latter being able to suffer a blow, provided all the frames are appropriately fastened, yet this rigid fastening system means that the vibrations due to the normal operation of the vehicle are transmitted to the paintings which on occasion can lead to them being damaged, especially when dealing with very old works on which the paint is very dry. These problems apply to the transportation of other articles in respect of which the said vibrations may give rise to the loosening-off of screws, the breakage of fragile connections, etc.

DESCRIPTION OF THE INVENTION

The packaging system proposed by the invention fully solves the abovementioned problems in each and every one of its various aspects.

To this end and more specifically, said packaging is based on the use of the conventional rectangular frame as a support element for the painting or article in question, but with the special feature that said painting is fastened to the frame with the collaboration of belts, preferably of a textile nature, which, with the collaboration of respective closing elements, such as, for example, buckles, extend in an annular manner between opposite sides of the frame, being perfectly tensioned and with their two parallel strands very close together. On each of these belts are mounted individual half-clamps, preferably made from textile strips of greater width, which are folded over on themselves so as to form "U"-shaped opposing concavities intended for coupling to the opposing edges of the painting or article to be fastened, specifically with the interposition of individual cushioned bodies with the aim of preventing said half-clamps being able to damage the said painting.

To complement the described structure and to appropriately stabilise the said half-clamps in a situation of pressure against the edges of the painting or element in question, provision has been made for the arrangement, immediately outside each one of them, of a type of clamp which can be moved along the corresponding double sector of the closing belt and can be fastened in any position on said belt so that moving the clamps as close as possible to the said half-clamps results in the blocking in position of the latter, in a situation in which the painting installed between them is perfectly fastened.

In accordance with this structure, the frame will be fastened in the vehicle in the most appropriate manner, preferably by means of vibration-insulating supports of the "silent block" type, so that said painting or article in question adopts a "floating" condition inside the package which means that it will not be affected by blows or vibrations, said supports ensuring optimum transportation conditions for the painting or article in question.

Returning again to the said clamps, each one is in the form of a grooved body of scant depth and of a width in accordance with that of the fastening belts for which it is intended, a grooved body between whose lateral branches is installed a bolt acting as a rocking axis for a short lever, relatively level at its free end or for manual actuation and rounded at its articulation end, but with the particular feature that this rounded sector is substantially eccentric so that when the lever is in a perpendicular position with respect to the grooved body the two superposed sectors of the fastening belt can pass freely between these elements, whilst when said lever rocks in a direction of lowering towards the inside of the grooved body, the passage defined between its rounded end and said grooved body is tightened considerably, leaving the clamp as a whole blocked with respect to the fastening belt and forming the stop which is necessary to immobilise the half-clamps which participate in the packaging system.

In a complementary manner and as a further feature of the invention, provision has been made for the said rocking lever to incorporate, in the fastening sector of its rounded end, a pair of longitudinal ribs of triangular profile and with a sharp edge which "clamp down" on the fastening belt, improving the grip of the clamp on the latter.

As for each shock-absorbing support, it is in the form of a forked part which, if the frame for which it is intended has cylindrical branches, will have the base of its fork grooved as a semicylindrical trough, a threaded orifice being installed in one of the branches of the fork and in which orifice is fitted a screw provided at its inner end with a short smooth sector which can be fitted into a blind orifice made in the inner face of the other branch of the forked part, said screw being topped on its outer end by a broad knurled actuating head and being assisted by a lock nut which ensures fastening of the same in a condition of closing the fork, to which end, and as is obvious, said screw will be located, in the context of said fork, in such a manner that it is immediately outside the corresponding arm of the frame when the latter is fully coupled in the base of the repeatedly mentioned fork.

To complement the structure described and as another of the essential features of the invention, the said forked part, in correspondence with the start of one of its lateral branches, receives, appropriately connected, a core made from an elastomer material from which there emerges, in turn, a small threaded rod which, in turn, constitutes the means of fastening the support to the structure in question, threading directly onto an orifice of the said structure or with the collaboration of the corresponding nut, this elastomer core constituting a "silent block" which confers on the support its shock-absorbing character or, in other words, its ability to absorb the possible vibrations which tend to reach the frame from the support structure.

The recommended package also incorporates a container which is structured on the basis of an annular body of rectangular cross-section involving four boards, in two identical pairs, although all four could coincide in terms of size, specifically if the annular body were of quadrangular cross-section, these boards being fastened together via their ends with the collaboration of four flanges, each one of which is structured on the basis of two dihedral and straight plates, one of which is intended to be fitted on the outside and the other on the inside of the said boards, with the additional particular feature that the outer dihedral plate incorporates in its inner face and in correspondence with its bisecting plane at least two threaded sleeves which act as spacers and connectors between both plates, whilst the other has its edge bevelled and is provided in said bevel with orifices for the passage of the screws which, acting on the previously mentioned threaded sleeves, establish a solid fastening between both dihedral plates, clamping the two corresponding boards between them.

In accordance with another of the features of the invention, with each one of these flanges and more specifically with their two threaded sleeves there collaborates a set of smooth sleeves of different axial dimension which, appropriately coupled to the threaded sleeves, permit adjustment of the spacing between the dihedral plates with the aim of adapting it to different thicknesses for the boards which it is to fasten.

In accordance with another of the features of the invention, while the inner plate has a length coincident with the width of the boards which are to constitute the annular body, the outer dihedral plate is slightly oversized in the longitudinal direction with respect to the inner plate, overhanging both ends thereof so that these overhanging ends of the four exterior dihedral plates constitute coupling passages for the rectangular panels which are to close the annular body, complementing the package, and which will be fastened by simple screwing to the edges of the boards making up the said annular body.

Finally, and in accordance with another of the features of the invention, the boards of the annular body are fastened inside the corresponding flanges with the interposition of elastic, for example rubber, leaves which hermetically seal this coupling, at the same time as individual rectangular seals are coupled to the free edges of the boards making up the annular body, said seals acting, in turn, as sealing elements in the coupling of the panels or covers which close said annular body.

A robust container is achieved in this manner, with its metal vertices and edges, which is consequently extremely strong and whose closure panels may have any thickness appropriate to each case so the mechanical protection of its contents is completely ensured, whilst an absolutely hermetic closure is also established which protects the contents of the container from environmental effects, especially from the effects of damp. It should also be added that, when the container is dismantled, it is converted into a series of dihedral laminar elements which occupies a minimal volume.

DESCRIPTION OF THE DRAWINGS

To complement the description being given and with the aim of assisting better comprehension of the features of the invention, the present specification is accompanied, as an integral part thereof, by a set of drawings in which, with an illustrative and non-limiting character, the following have been shown:

FIG. 1—shows a perspective view of a painting, in a transportation condition, in accordance with the packaging system which constitutes the subject of the present invention.

FIG. 2—shows a detail in transverse section of the assembly shown in the previous figure, in accordance with the section line 2—2 in said figure.

Figure 3:
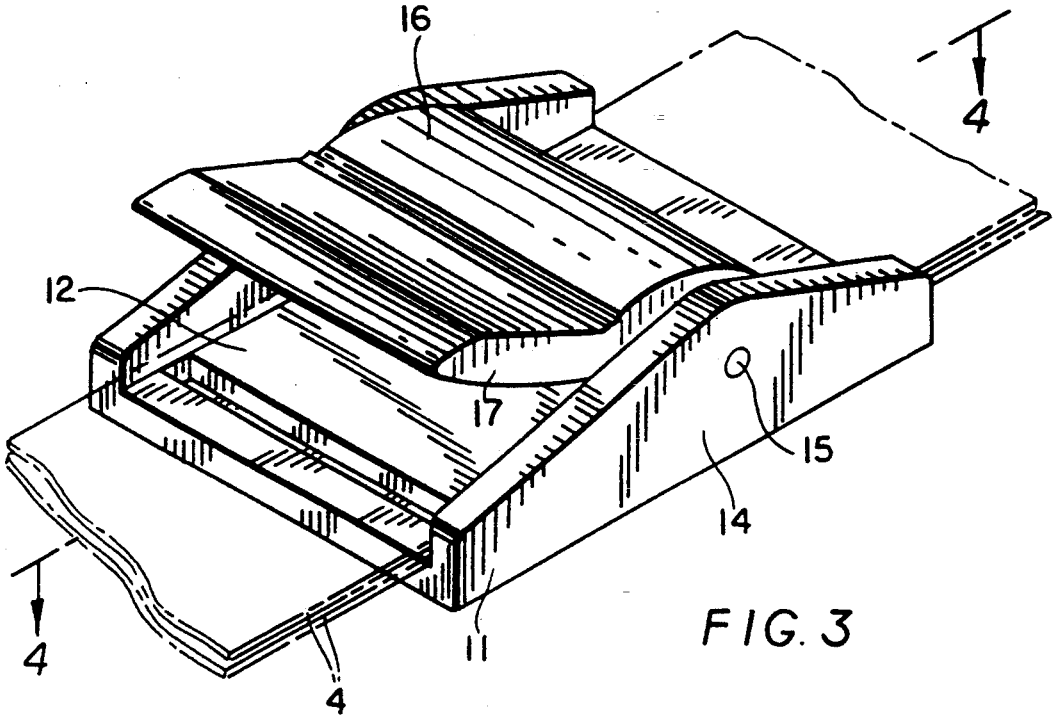
FIG. 3—shows a perspective view of a retention clamp for fastening belts in packaging frames for paintings and the like, produced in accordance with the subject of the present invention and in which the said fastening belt is shown in broken lines.

A consideration of these figures makes it possible to see how the system for packaging paintings, other works of art and the like, which forms the subject of the present invention, is based on the use of a preferably metal frame (1) with dimensions and with a rigidity which are appropriate to the type of article to be transported such as, for example, the painting (2), this frame (1) having in appropriate zones thereof supports (3) for fastening it to the transport vehicle, these supports preferably having vibration-insulating characteristics and having an adjustable frame position in order to adopt the most suitable position in each case in accordance with the characteristics of the vehicle.

Between each pair of opposing branches of the frame (1) are installed two belts (4), preferably of a textile nature, each one of which is closed on itself with the collaboration of a buckle or any appropriate closure element (5), which permits said belt to be perfectly tensioned.

On each one of these belts (4), intended to receive within it the painting (2) or article in question, and in correspondence with the likewise corresponding edges of the latter, are incorporated individual half-clamps (6), preferably made from short strips, also of a textile nature, but of greater width, which fold over on themselves and which incorporate in their end zones individual pairs of cuts (7) defining a kind of fastener for their coupling to the belt (4), these half-clamps (6) having their concavities opposite each other and being adapted to the edges of the painting (2) or element in question, with the collaboration of thick cushioned bodies (8) which ensure perfect protection for the painting (2), avoiding risks of damage on the fastening zones thereof.

For these half-clamps (6) to operate, on the end sectors of the belt (4) and immediately outside said half-clamps (6) are installed individual clamps (9) which, in an open condition, are capable of moving along the double belt (4), but which in a closed position and as shown in FIG. 2 are rigidly fastened to said double belt (4) and form retention stops for the half-clamps (6) which hold the latter pressed against the painting (2) or element in question, these clamps (9) collaborating in the greater tensioning of the belts (4), as may also be seen in the said FIG. 2.

In accordance with this structure, as stated previously and as may be appreciated from a simple observation of FIG. 1, the painting (2) or element in question is thus fastened to the frame (1) in a floating manner, in the centre thereof, such that said painting (2) is not only perfectly joined to the frame and protected thereby, but the possible vibrations which may reach said frame, which are already minimised by the vibration-insulating supports (3), finally disappear completely in the belts (4), the painting (2) or article in question not being affected by said vibrations, which means that its transportation, with the packaging system recommended, takes place under optimum conditions.

Figure 4:
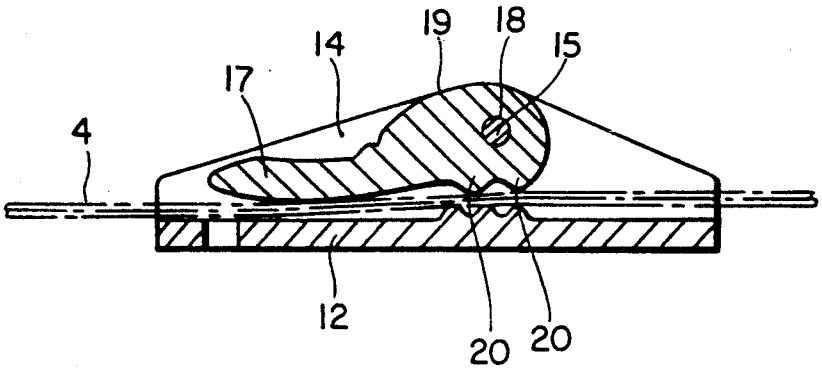
FIG. 4—shows a longitudinal section of the assembly shown in the previous figure, in accordance with the section line 4—4 in said figure.
Figure 5:
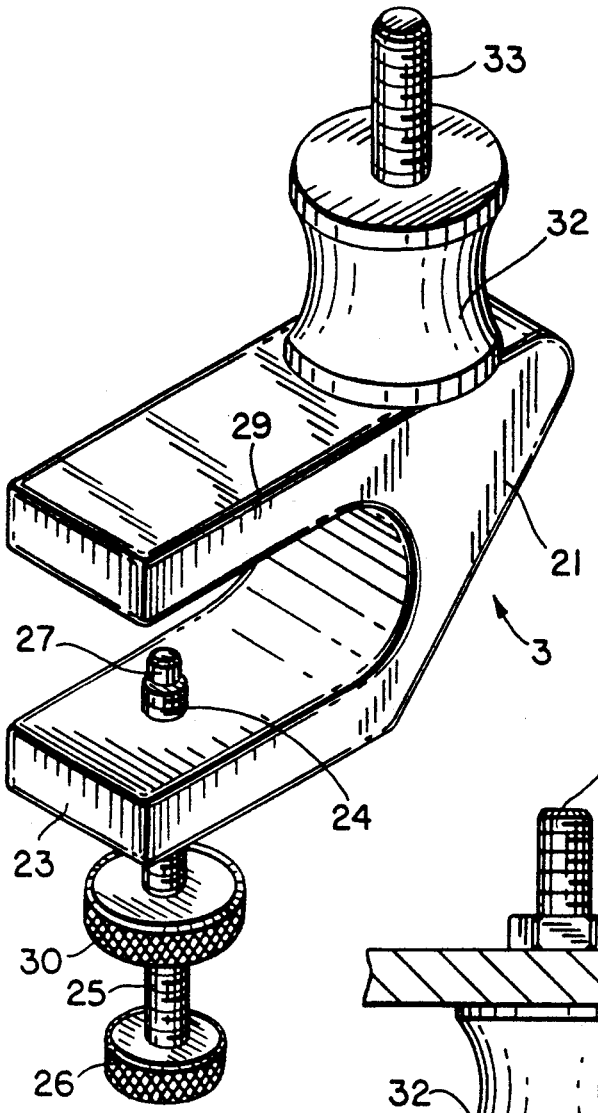
FIG. 5—shows a perspective view of a shock-absorbing support for packaging frames for paintings and the like, produced in accordance with the subject of the present invention.

The retention clamp (9), as may be observed in FIGS. 3 and 4, consists of a grooved body (11), specifically of "U"-shaped cross-section, whose middle branch (12) has a width coincident with that of the fastening belt (4) which has to slide inside it, its lateral branches (14) being of scant height and preferably having a free edge with a dihedral and asymmetric configuration, there being installed in correspondence with the point of greatest dimension of said lateral walls (14) a transverse bolt (15) acting as a rocking axis for a lever (16) which can be fitted inside the grooved body (11), as shown in FIG. 3, the free end of which lever (17) adopts a level configuration, constituting its manual actuation sector, whilst, in its opposite zone, it incorporates a transverse orifice (18) in which the said bolt (15) is fitted, acting as a rocking axis, this other end sector (19) adopting a rounded configuration but with a certain eccentricity such that, as has also been stated previously, when the level sector (17) of the lever adopts a position of spacing with respect to the grooved body (11), between its rounded sector (19) and the base (12) of said grooved body there is a spacing which is sufficient to permit the free passage of the double belt (4), that is to say to permit the clamp to move freely along said belt (4) until it adopts the most ideal positioning thereon, at the end of which movement and by means of simple rocking of the lever (16), acting on its end (17), as far as the position of lowering on the grooved body (11) as shown in FIG. 4, it determines the tightening of the said passage and specifically the clamping of the belt (4) and consequently fastening of the clamp thereto.

In a complementary manner, as has already been stated previously and as may be observed also in FIG. 4, this tightening sector of the end (19) of the lever (16) is additionally provided with a pair of transverse ribs (20) of angular profile and sharp edge, which are intended to be "clamped down" on the fastening belt (4), enhancing the grip of the clamp thereto and, consequently, ensuring the stability of said clamp in a working position, as a non-removable stop for the half-clamps which participate in the floating packaging system for the painting or article in question.

Figure 6:
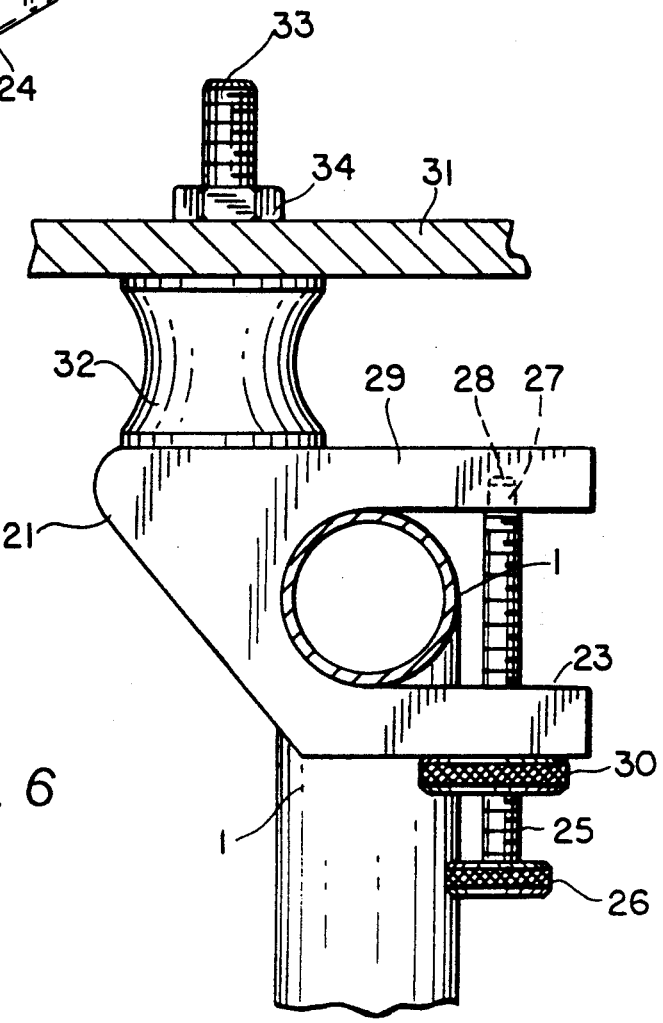
FIG. 6—shows an example of practical use of said support, according to a view in lateral elevation.

As for the shock-absorbing support (3) which is recommended, it is structured on the basis of a forked part (21), of basically "U"-shaped configuration, whose middle branch adopts, on the inside, a semicylindrical trough configuration in that specific case in which the frame (1) for which it is intended has a circular cross-section, being diametrically coincident with the latter, said forked part (21) being provided, on one of its lateral branches, that with the reference number (23), with a threaded orifice (24) in which is fitted a screw (25) topped at its outer end by a knurled head (26) and which at its inner end incorporates a short smooth sector (27) via which it is inserted in a cylindrical and blind orifice or housing (28) established in the inner face of the other lateral branch (29) of the forked part (21), as may be observed in FIG. 6.

The said screw is intended to permit access of the frame (1) to the support and to retain it inside the latter, as may be seen especially in FIG. 6, the screw (25) having a lock nut (30) which prevents possible or accidental loosening-off thereof.

In a complementary manner and for its fastening to the corresponding support structure (31), as also shown in FIG. 6, to the middle branch of the forked part (21), specifically in correspondence with the start of one of the lateral branches (29), is joined by any appropriate means a core (32) of rubber or other elastomer material, to which, in turn, is joined a threaded rod (33), such that the fastening of the support (21) to the structure (31) takes places via a rod (33) with the collaboration of the corresponding nut (34), thereby achieving the claimed shock-absorbing effect for the support, as stated previously, since this core (32) of elastomer material acts in the manner of a "silent block" which absorbs the possible vibrations transmitted to the structure (31), preventing these passing via the actual support (21) to the frame (1) and from the latter to the painting or article fastened therein.

Finally, it should be pointed out that the special fastening which the forked part (21) constitutes for the frame (1) defines an articulated coupling which permits the rocking of said frame (1) which, in turn, permits the fastening thereof to be achieved under optimum conditions regardless of the orientation of the structure (31) with respect to said frame, that is to say regardless of whether the position of the frame (1) has to be perpendicular to the structure (31), as shown in FIG. 6, parallel or with any other intermediate angular position.

Figure 9:
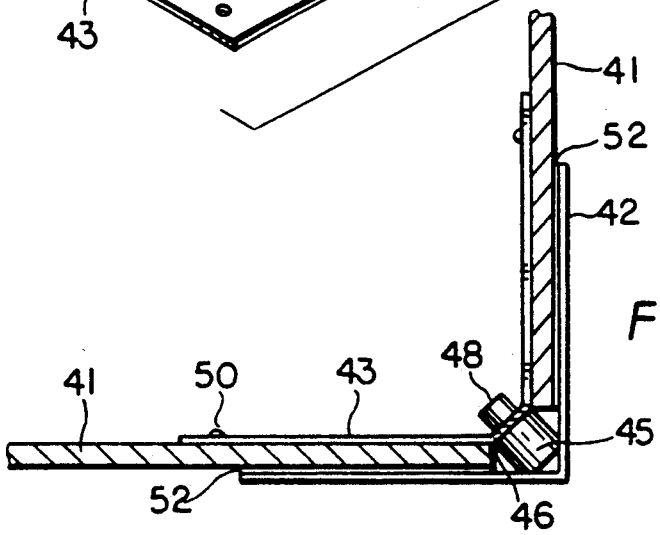
FIG. 9—shows a detail in profile of the coupling between two boards of those making up the annular body, at the expense of a flange like that in FIG. 8.
Figure 10:
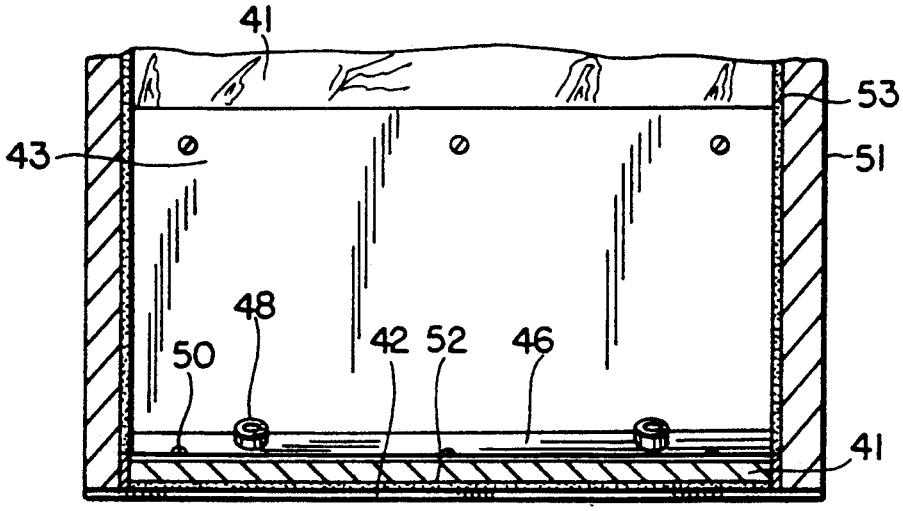
FIG. 10—shows, finally, a view in internal elevation of the assembly shown in the previous figure.

Finally, and with reference to the complementary container shown in FIGS. 7 to 10, the latter is constructed from four boards (41), of dimensions which can vary as a function of those which the package as a whole must have, and which in any case are intended to form the walls of an annular, rectangular or quadrangular body, being fastened together with the collaboration of a like number of flanges, each one of which is constructed by means of two straight dihedral plates, an exterior plate (42) and an interior plate (43), the exterior plate (42) having on its edge (44) and in correspondence with an imaginary bisecting plane, a pair of threaded sleeves (45) appropriately joined to the plate (42), for example by welding, while the interior plate (43) has in correspondence with the same edge a bevel or plane (46) inclined at 45°, provided with orifices (47) which in an operational position are opposite the sleeves (45), for the passage of respective fastening screws (48) so that in a position of tightening for said screws (48) between the lateral branches of the plates making up the flange there are housings for the end zones of the boards (41) which are thus "clamped", as may be seen especially in FIG. 9.

Nevertheless, and as is obvious, the outer dihedral plate (42) could be equipped in correspondence with its edge (44) with a bevel similar to the bevel (46) of the inner plate, in order to favour installation of the threaded sleeves (45), and also the thread for fastening the screws (48) could be produced in orifices in this assumed bevel in the exterior dihedral plate (42).

In any case, smooth complementary sleeves (49), of different axial dimensions, are capable of collaborating with the fixed sleeves (45) with the aim of the spacing between the dihedral plates (42) and (43), in accordance with the assembly position shown in FIG. 9, being adapted to different depths or thicknesses for the boards (41) which, for example, may be 9 mm when the threaded sleeves (45) are used exclusively, 19 mm when the spacer sleeves (45') of smaller size are used, and 30 mm when those of greater size are used, there being virtually no limitation in this respect.

Inside the said flanges (42–43), the inner dihedral plate (43) whose length is coincident with the width of the boards (41), has, in addition to the orifices (47) for passage of the screws (48) for tightening the flange, orifices (49) for the screws or wood screws (50) with which the said boards (41) making up the annular body are fastened to the inner plates (43) of each flange.

Figure 7:
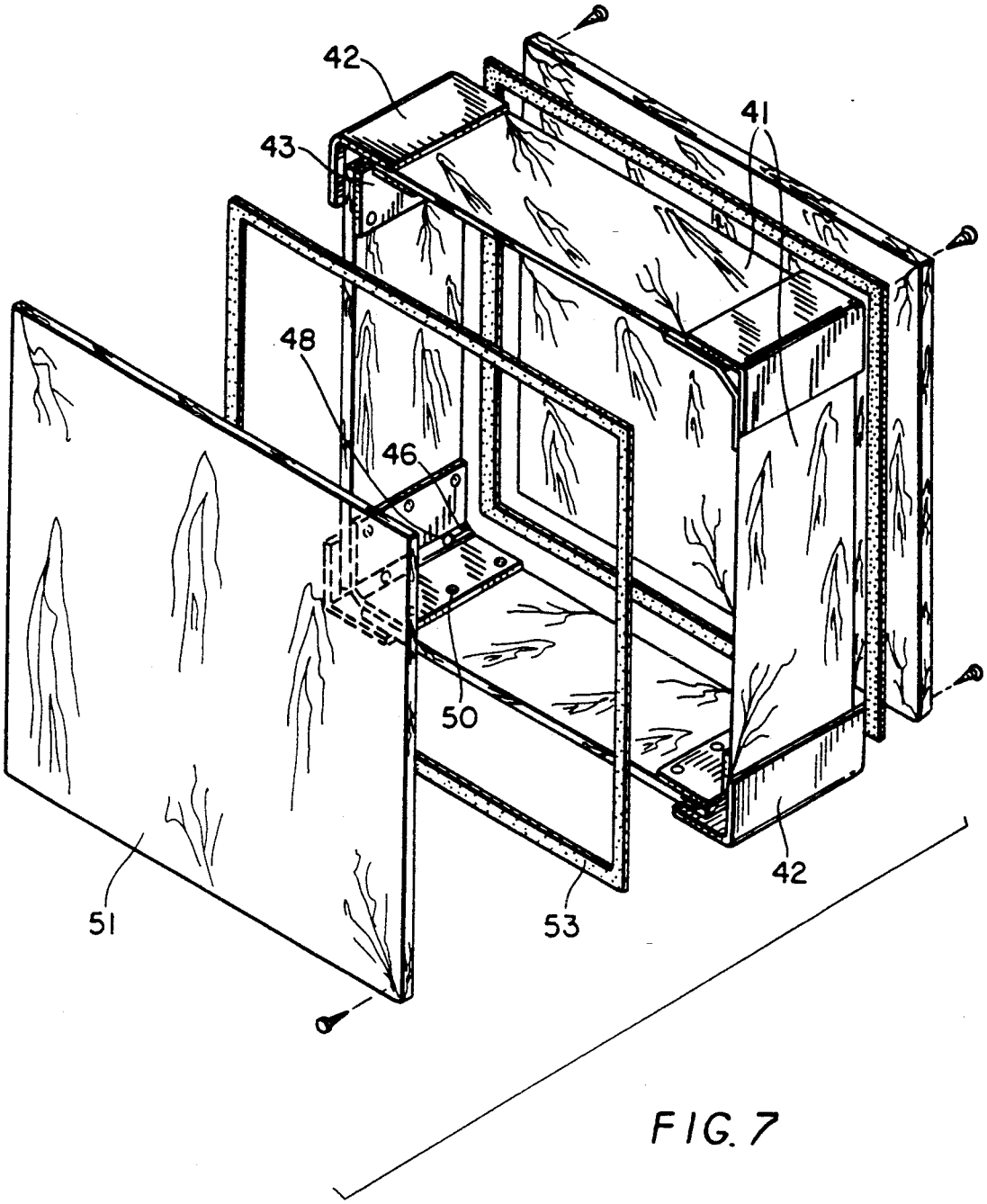
FIG. 7—shows a cutaway view in perspective of the container for paintings, works of art and the like, produced in accordance with the subject of the present invention.
Figure 8:
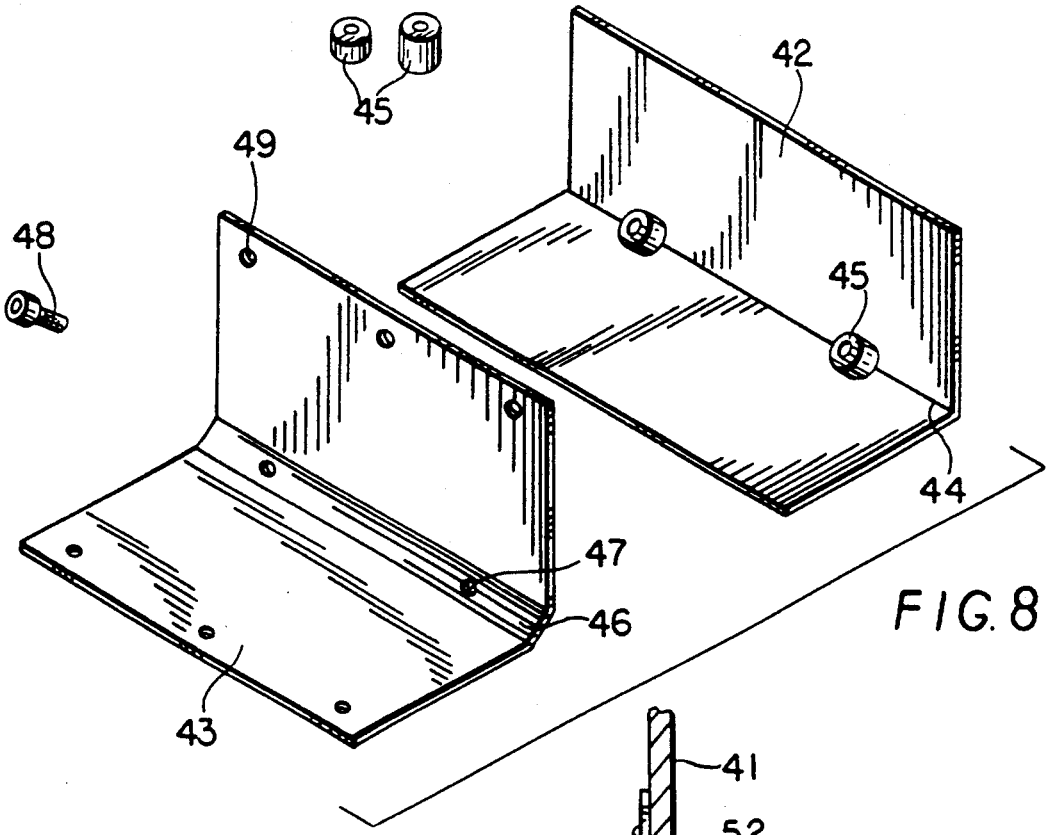
FIG. 8—shows a cutaway view, also in perspective, of one of the flanges which participate in the container in the previous figure.

For their part, the exterior dihedral plates (42), whose length is substantially greater than that of the inner plates (43) and consequently greater also than the width of the boards (41), overhang at both ends with respect to the latter, as shown in FIG. 7, with the aim of forming recesses for the perfect installation and protection of the corners of panels (51) which, in the manner of covers, close the tubular or annular body constituted by the panels (41), the size of the overhanging sector of the exterior plates (42) being sufficient for the panels (51) to be perfectly protected regardless of the thickness thereof, these panels being fastened to the remainder of the package, specifically to the boards (41), by means of screwing onto the edge of the latter.

It only remains to point out, finally, that, with the aim of rendering the package perfectly leakproof, between the boards (41) and the fastening flanges, for example between the boards (41) and the outer plates (42), are installed leaktight seals (52), as between the passages of the annular body, that is to say between the free edges of the boards (41) and the panels or covers (51), where there are also located leaktight seals (53) with the same rectangular configuration as the annular body.

Although the present description has been made on the basis of a prismatic/rectangular configuration for the package, this being the most usual, said package could obviously assume any other configuration when its practical use makes this appropriate, such as, for example, a prismatic/hexagonal or prismatic/octagonal configuration, all that is required being variation of the number of boards (41) which participate in the annular body and the number of flanges (42–43) for fastening said boards, as well as the angular position of the plates making up said flanges and the configuration of the panels or covers which will assume the same polygonal configuration as the annular body.

I claim:

1. A packaging system for works of art comprising:

a frame dimensionally and structurally suitable for receiving the work of art within the interior of the frame;

fasteners for connecting the frame to a support, said fasteners insulating the frame from vibrations from the support;

first and second belt means, each having ends secured to opposing portions of the frame and each belt means having a closure for closing the belt means under tension, the belt means having opposing portions for receiving the work of art therebetween and securing it within the interior of the frame;

first opposing clamps attached to the belt means movable between a first position wherein the work of art is secured between the opposing clamps and the opposing portions of the belt means and a second position wherein the work of art is not so secured; and second clamps attached to the belt means for adjusting and maintaining the first clamps between the first and second positions.

2. The packing system of claim 1 wherein the first and second belt means are strips of fabric, portions of which are wrapped around opposing portions of the frame such that the portion of the belt means interior of the frame comprises said opposing belt portions, and the first clamps are textile strips slidably mounted on said opposing portions of said belt means.

3. The packing system of claim 1 wherein said second clamps are slidably attached to said belts and have closure means movable between open and closed positions, said clamp being movable on said belt when said closure means is in an open position and being immovable when said closure means is in said closed position, said second clamps restraining movement of said first clamps when said closure means is in said closed position.

4. The packaging system of claim 3 wherein the second clamp comprises a body having a channel for receiving said belt means, a lever, eccentrically pivotably connected across said channel forming with said channel, a slot within which said belt means is movable positioned, said lever being movable between an open and a closed position, said second clamp being movable on said belt when the lever is in the open position and immovable when the lever is int he closed position.

5. The packaging system of claim 4 wherein the edge of the eccentric lever has a surface having angular ribs having sharp edges which contact said belt and enhance securement of said second clamp to said belt when said lever is in said closed position.

6. The packaging system of claim 1 wherein said fasteners comprises a base having opposing flanges, said flanges forming a groove for receiving said frame between said flanges, and means for tightening the flanges against the frame, and cushion securement means for connecting the frame in cushioned relationship to the support 7. The packaging system of claim 1 wherein said support comprises:

a container composed of side panels defining an enclosure for receiving the frame, the said panels having ends connected to one another by pairs of opposing brackets having a spacer therebetween such that opposing portions of each bracket are spaced apart and define a slot for receiving the end of a panel, and means for securing said brackets to said panels.

8. The packaging system of claim 7 wherein said spacer is adjustable so as to change the width of the slot between the brackets.

9. The packaging system of claim 7 wherein said support further comprises closure panels for completely enclosing the interior of said support.

10. The packaging system of claim 9 wherein said support further comprises sealing means for providing leak-tight seals between the interior and the exterior of the support.

* * * * *